US005174316A

United States Patent [19]

Keller et al.

[11] Patent Number: 5,174,316

[45] Date of Patent: Dec. 29, 1992

[54] METHOD AND APPARATUS FOR CLEANING MATERIAL RECOVERED FROM SOILED PLASTIC CONTAINERS, PACKAGING AND THE LIKE

[75] Inventors: Roy R. Keller, Arlington; Frank E. Kline, Houston, both of Tex.

[73] Assignee: Food Technology International Inc., Grand Prairie, Tex.

[21] Appl. No.: 665,407

[22] Filed: Mar. 6, 1991

[51] Int. Cl.[5] ..... B08B 3/04

[52] U.S. Cl. ..... 134/104.3; 134/182; 241/60; 366/337

[58] Field of Search ..... 134/132, 182, 183, 104.3; 366/336, 337, 338, 339, 340, 341; 241/60

[56] References Cited

U.S. PATENT DOCUMENTS

| | | | |
|---|---|---|---|
| 3,664,354 | 5/1972 | Minbiole, Jr. et al. | 134/182 X |
| 3,704,006 | 11/1972 | Grout et al. | 366/339 X |
| 4,135,829 | 1/1979 | Grillo et al. | 366/337 |
| 4,594,005 | 6/1986 | Sakamoto et al. | 366/336 X |
| 4,674,888 | 6/1987 | Carlson | 366/337 |

FOREIGN PATENT DOCUMENTS

| | | | |
|---|---|---|---|
| 2221426 | 9/1987 | Japan | 366/336 |

*Primary Examiner*—Philip R. Coe
*Attorney, Agent, or Firm*—Charles W. McHugh

[57] ABSTRACT

A cleaning apparatus includes a shredder that converts plastic containers, packages and cups into relatively small fragments (e.g., about one to two square inches) to promote cleaning. The shredder intake may be located below the discharge end of a conveyor upon which plastic items are placed after being separated from other refuse in a salvage operation. Fragments produced by the shredder are delivered to a reservoir containing many gallons of cleaning liquid, e.g., water and a detergent. A pump propels the liquid and light-weight plastic fragments (typically foamed polystyrene) to an elongated chamber that serves to turn and twist the fragments with sufficient turbulence so as to clean them during their excursion through the chamber. Turbulence is preferably achieved by providing a plurality of static devices constituting fixed obstructions around which the pumped liquid flows. The obstructions are placed at locations and angles that force the liquid-borne plastic particles to repeatedly shift position and change direction in a chaotic manner as they move through the chamber. The pump-driven fragments eventually leave the elongated chamber and exit to a solids/liquid separator. A substantial portion of the filtered liquid is then returned to the wash tank, on a continuous basis, for making another excursion through the elongated chamber. The clean plastic fragments are moved by a conveyor to a drying chamber where they are subjected to a high volume of heated air-to ensure that they are sufficiently dry to be packaged for recycling.

11 Claims, 2 Drawing Sheets

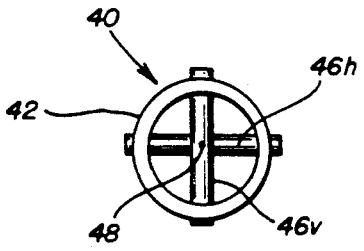
FIG. 4
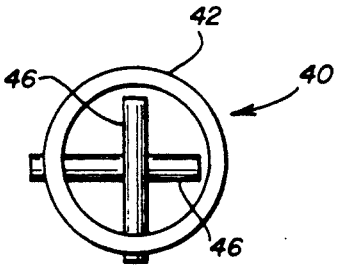
FIG. 5
FIG. 6
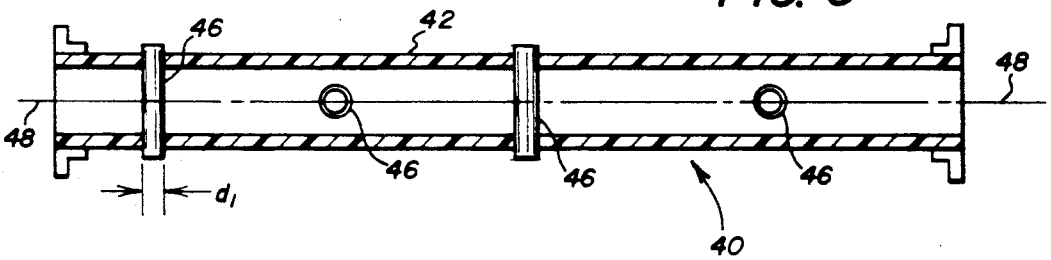
FIG. 7
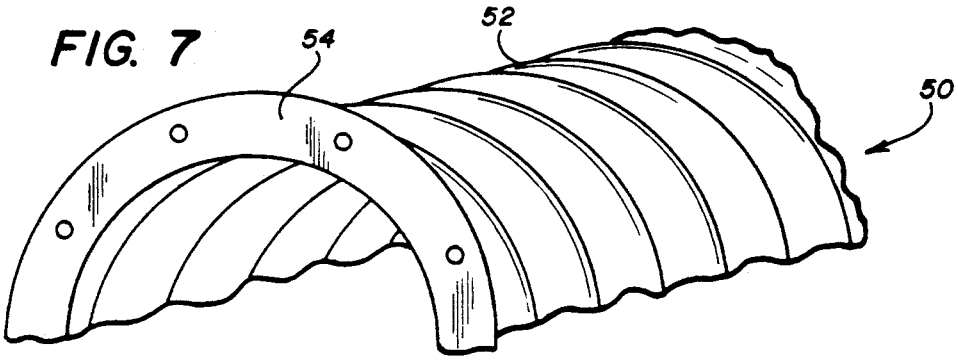

METHOD AND APPARATUS FOR CLEANING MATERIAL RECOVERED FROM SOILED PLASTIC CONTAINERS, PACKAGING AND THE LIKE

BACKGROUND OF THE INVENTION

This invention relates generally to the recycling of waste materials; more specifically, it relates to an apparatus having particular utility in the cleaning of used plastic containers, packaging and the like. One use for such an apparatus is to clean the polystyrene material recovered from food containers that are commonly used by so-called fast food restaurants to dispense food products such as hamburgers, breakfast sandwiches, coffee, etc. Another use is to clean the polyethylene recovered from milk cartons, oil jugs, antifreeze containers, soap and detergent bottles, etc.

It is well known that many communities are rapidly approaching a crisis stage in dealing with solid waste products. This is because the most common technique of disposing of such products has been to bury them, along with other trash, in "solid" landfills. As old landfills have approached their capacity to receive fresh trash, sites for locating new landfills have been complicated by the difficulty of finding suitable land and an increased concern for environmental factors, including the possible contamination of ground water by chemicals that sometimes leach out of such landfills. To perhaps reduce the burden on traditional landfills, many persons have turned their attention to minimizing the solid waste that must be accommodated as a result of having to deal with plastic containers and packaging, especially those that have not been formulated so as to be biodegradable. It is no secret that if packaging waste could be minimized, then landfills could be used much longer before they are full.

It is also well known in the plastics industry that flawed packages, cups and containers for food and beverages can frequently be recycled by grinding or chopping the flawed products and using the resultant particulate material as a portion of the feed stock that is supplied to an extruder or the like. Examples of teachings on this subject can be found in the following U.S. Pat. No. 3,000,055 to Schlicksupp entitled "Grinding, Mixing and Feeding Apparatus for Plastic Molding Machines," No. 4,091,967 to Kinoshita entitled "Device for Dealing with the Scraps of Foamed Thermoplastic Synthetic Resins," and No. 4,254,068 to Otsuka entitled "Method and Apparatus for Regenerating Foamed Plastics." Of course, the recycling of scrap and rejects in a factory is done under circumstances that may be described as relatively clean, because scrap and rejects have not yet been soiled by the solids or liquids that such containers and packages are designed to hold. Therefore, the principles that apply to the traditional reuse of scrap and rejects in a factory cannot be transferred—without alteration—to recycling centers where contaminated packages and containers are accumulated.

When it is contemplated that one might wish to recycle used food and beverage packages (such as those used to serve hamburgers, coffee and similar food products at fast-food restaurants), a significant problem arises, namely, how to deal with the now-soiled plastic packages. By use of the word "soiled," reference is being made to the residue that remains on a package after all large food particles have been removed. Such residue may include what is left of food that was supplied by the original food preparer, as well as other items such as garnishes that may have been supplied by a purchaser. Additionally, there may be items such as chewing gum that were never an integral part of someone's meal but which frequently show up in discarded trash. Of course, chewing gum, like mustard and the like, does not readily shake free of a package when an attempt is made to empty the package of any remaining food. Therefore, it must be contemplated that discarded food containers may be soiled (or contaminated) with one or more of the following items: catsup, mayonnaise, mustard, relish, grease, butter, margarine, jelly, vinegar, salad dressing, taco sauce, refried beans, gravy, tartar sauce, dried egg, soy sauce, chicken fat, syrup, chocolate, ice cream—and the juices that are produced by tomatoes, hot peppers, pickles, and onions, etc. It follows, then, that used food and beverage containers must somehow be cleaned of such contaminants before the plastic in such containers could ever be seriously considered for recycling. Furthermore, such containers must be cleaned within hours of the time that the containers (along with other trash) are received in a recycling center. (It should be no surprise that authorities who are responsible for public health will not tolerate the accumulation of trash that might attract rodents, flies, cockroaches, etc.) It is an object of this invention to provide a cleaning apparatus that is serviceable as a necessary part of a recycling apparatus—said cleaning apparatus being useful to clean the packaging material and render it fit for subsequent processing.

Recognition of the need for an effective cleaning apparatus is, of course, not a recent event. At least as early as 1977, a U.S. patent application was filed by Paul G. Marsh entitled "Recovery of Plastic From Municipal Waste"; this application matured into U.S. Pat. No. 4,160,772 in 1979. In the Marsh patent, it is acknowledged that the product realized from practice of the '772 invention may require further cleaning before it is used in a recycling process. But the only cleaning solution offered by Marsh was a conventional shaking screen, which is reportedly well known in the preliminary cleaning of rags in the preparation of paper-making stock. Of course, the kinds of contaminants that are likely to be on food containers are probably going to be much harder to remove than any accumulation of dust, etc. It follows, therefore, that there has remained a need for a cleaning apparatus that will render suitable for recycling those plastics that were described by Marsh, but which are contaminated to a degree that presumably was never considered by Marsh. An object of this invention is to satisfy that need.

Another object is to provide a cleaning apparatus that can operate without any moving parts, but which provides substantial turbulence within a cleaning liquid—to foster the kind of agitation and movement that is conducive to cleaning all surfaces of a package fragment.

Still another object is to provide a cleaning apparatus whose size and shape can be readily altered, as required, to fit the particular volume of material that is to be handled.

One more object is to teach a technique for reclaiming the plastic in used food containers, for the purpose of reusing the raw materials that were originally used to make the containers, as well as reducing the need for waste disposal space for solid materials.

A further object is to teach an apparatus that is usable for cleaning a variety of different plastic materials with only small alterations, such as harvesting plastic fragments from the bottom of a water tank instead of the top of the tank (when the fragments are heavier than water), etc., These and other objects will be apparent from a reading of the specification and the claims appended thereto, and with reference to the drawings attached hereto.

BRIEF DESCRIPTION OF THE INVENTION

In brief, the invention comprises a cleaning apparatus which is able to take soiled plastic containers, packages, bottles, cups, etc., and convert such items into clean, dry fragments that can be reused in the same manner that scrap and rejects are capable of being used in a factory that produces the original items. The first part of such an apparatus is a shredder that can convert the myriad number of containers, packages and cups into relatively small fragments having a size that is conducive to being cleaned; a suitable size is about one to two square inches. The shredder may be conveniently located below the discharge end of a conveyor upon which plastic items are placed after being separated from other refuse such as metal, glass or paper. The fragments produced by the shredder are delivered to a reservoir in which are maintained many gallons of cleaning liquid. When the containers being processed are primarily soiled with water-soluble materials, the cleaning liquid will naturally be water and, preferably, a detergent or the like. When the salvaged containers have once held a petroleum-based product, a first reservoir may be filled with a specific solvent for the product. A subsequent reservoir may contain a different cleaning liquid, such as a water-based liquid. Each reservoir also serves as a separator for light and heavy components, by relying on flotation principles.

When the raw material being salvaged constitutes food containers, a pump is used to remove light-weight plastic fragments (typically foamed polystyrene) from the reservoir, and to deliver those fragments to an elongated chamber that serves to turn and twist the fragments with sufficient turbulence so as to clean them during their excursion through the chamber. The desired turbulence is preferably achieved by providing in the chamber a plurality of completely passive devices. By use of the term "passive" it is meant something that has no moving parts. Hence, only the pump that propels the carrier liquid has any parts that are subject to active wear, and only the pump has any seals that might someday require attention or maintenance. The preferred manner of achieving the desired turbulence involves placing a plurality of fixed obstructions within the chamber so that the pumped liquid will flow over or around the obstructions. The obstructions are typically placed at locations and angles that force the liquid-borne plastic particles to repeatedly shift position and change direction in a chaotic manner as they move through the chamber. The pump-driven fragments eventually leave the elongated chamber and exit to a solids/liquid separator, which might also be called a drainer. The liquids that are extracted at the separator are filtered (as necessary) to remove the things that were once stuck to the plastic fragments but which are now held in suspension in a liquid bath. A substantial portion of the filtered liquid is then returned to the wash tank, on a continuous basis, for making another excursion through the elongated chamber. The now-clean plastic fragments are moved by a conveyor to a drying chamber where they are subjected to a high volume of heated air—to ensure that they are sufficiently dry to be packaged for transfer to a location where they can be recycled.

BRIEF DESCRIPTION OF THE FIGURES OF THE DRAWING

FIG. 4 is an axial elevational view of a segment of an elongated chamber through which plastic fragments and a cleaning liquid move during a wash cycle, and showing the preferred arrangement of turbulence generators, in the form of right cylinders;

FIG. 5 is another embodiment of turbulence generators that are similar to those shown in FIG. 5, but which differ by being shorter than the diameter of the elongated chamber;

FIG. 6 is a cross-sectional view of a segment of an elongated chamber, taken in the plane represented by the lines 6—6 in FIG. 4; and FIG. 7 is a perspective view of a sleeve-like member that is adapted to slip inside a smooth-walled pipe, to provide the desired turbulence in a liquid that is passing through the pipe.

DETAILED DESCRIPTION OF A PREFERRED EMBODIMENT OF THE INVENTION

Figure 1:
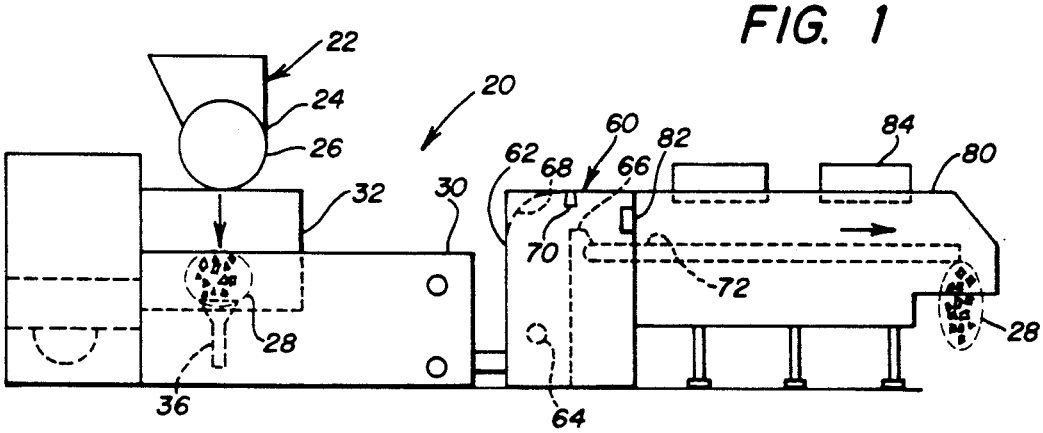
FIG. 1 is a schematic view of most of a cleaning apparatus in accordance with this invention, showing—in elevation—certain major components of the overall system, but omitting the elongated washing chamber.
Figure 2:
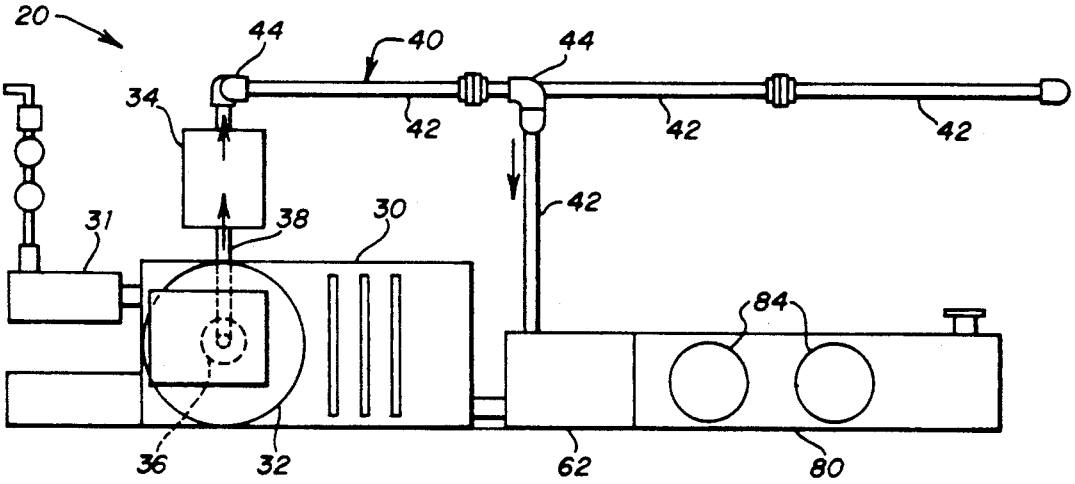
FIG. 2 is a top plan view of the cleaning system shown in FIG. 1, and showing the location of the elongated washing chamber in this particular embodiment.

Referring initially to FIGS. 1 and 2 of the attached drawing, an exemplary cleaning apparatus 20 is shown for cleaning containers and the like that once held food or similar water-soluble materials. By use of the term "soluble" it is not intended to suggest absolute solubility in a chemical sense (as sugar can be dissolved in water); instead, it is intended to refer to the ability to render a substance free of attachment to some solid body. Hence, a slice of banana may be considered to be water-soluble for the purposes of this disclosure, because water will break the bonds of adhesion between the banana and a solid article, thereby permitting the banana to be washed away. The apparatus 20 includes a hopper 22 that will typically be placed alongside a conveyor belt in a material recycling center that has been designed to receive bags of trash from schools, restaurants, industries and others who are committed to minimizing the amount of solid waste that must be taken to a community's landfill. Such trash bags are commonly dumped onto the end of a first conveyor, and the contents are taken by the conveyor past a group of human pickers and sorters who manually pick up readily identifiable materials and send them to appropriate hoppers for processing. For example, metal, aluminum, glass, and plastic materials are typically sent to separate areas in the recycling center for appropriate handling.

The hopper 22 has relatively steep sides in order to minimize any tendency of anything, including food matter, to collect on the inside surfaces of the hopper. The hopper's exit 24 feeds soiled containers into a grinder or shredder 26 whose purpose is to take in all sizes, shapes and types of plastic containers and packaging materials—and expel plastic fragments 28 having a fairly small and reasonably uniform size. The preferred size of the fragments 28 is on the order of one to two square inches. A suitable shredder for this purpose is commercially available from Prodeva Inc. and is marketed as a Model 315 plastic shredder. A characteristic of this particular shredder is that the size of the expelled fragments 28 may be easily adjusted by the simple act of changing an "exit" grate through which all of the fragments pass. By removing a grate with large holes and replacing it with one having smaller holes, the plastic material will be kept in the shredder for a longer period of time; but eventually the plastic material will be cut into fragments 28 that are small enough to pass through the smaller holes.

The plastic fragments 28 are delivered, usually by relying on gravity, from the shredder 26 to a reservoir 30 containing a pool of cleaning liquid that is several feet deep. The pool of liquid may be heated as desired by an immersion heater 31, usually to a temperature in excess of 120° F. The reservoir 30 serves to collect the fragments and place them in intimate contact with the liquid that will serve as their carrier through the next phase of the cleaning process. The reservoir 30 also serves as a separator for the plastic materials that are being cleaned. Assuming that the plastic material that is of interest is polystyrene, the natural buoyancy of polystyrene in water will be relied upon to accumulate fragments 28 near the top of the reservoir. To preclude dispersal of the fragments 28 over the entire top of the reservoir 30, a collector ring 32 is placed below the shredder 26 at an elevation where it will rest partially above the reservoir and partially below the water level in the reservoir. The collector ring 32 may conveniently be an open cylinder whose diameter is about one-half that of the length of the reservoir 30. The value for the diameter of an exemplary collector ring is five feet.

An important function of the collector ring 32 is to provide a fragment-rich source of water and plastic at the supply inlet of a pump 34. The pump is used to propel the water and plastic fragments through an elongated washing chamber 40 that is downstream of the reservoir 30. The size of a suitable pump is primarily a function of the expected capacity of a given cleaning apparatus 20. Assuming that the apparatus 20 is sized to handle as much as 600 pounds of polystyrene per hour, a typical pump 34 should be able to propel 150 gallons of water per minute through a four-inch pipe. A suitable pump 34 is a Model 4DX3 self-priming diaphragm pump manufactured by Gorman-Rupp, further described as a 3 horsepower aggregate pump.

Figure 3:
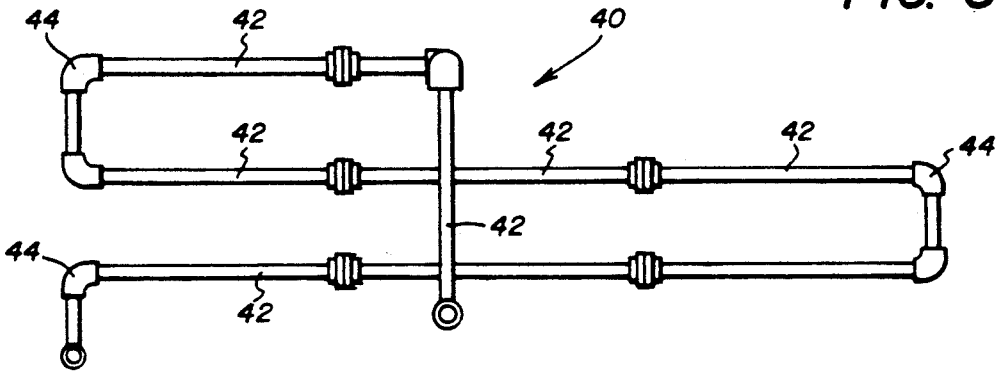
FIG. 3 is a front elevational view of one embodiment of an elongated washing chamber, showing that it may be arranged in a series of multidirectional segments when space does not permit the chamber to extend linearly for the full length that is deemed necessary.

The supply inlet of pump 34 is preferably a funnel 36 which is placed so that its top will be below the normal water level in the reservoir 30. The bottom (and narrow) end of the funnel 36 is in direct communication with the inlet of pump 34 through a short pipe 38 (shown in FIG. 2). The outlet of pump 34 is directly to an elongated washing chamber 40, one embodiment of which is shown in FIG. 3. This particular embodiment consists of a series of connected pipe segments 42, joined by 90° elbows 44 to form a more compact arrangement than would otherwise be necessary were the washing chamber 40 to be linear. Relatively short pipe segments 42 (having a length of about eight to twelve feet) and the connecting 90° elbows 44 actually have a major beneficial effect—namely, besides saving space, they contribute to the non-laminar flow which is desired for the liquid moving through the chamber 40. Indeed, even when space might permit a given wash chamber to extend linearly for its full design length, it is usually preferable that the chamber be broken up into a series of segments that are joined end to end and making angles with respect to their adjacent segments of at least 45°. As a general rule, it is believed that the desired turbulent flow is best achieved with at least one-fourth of the pipe segments being connected to adjacent segments by an angle of approximately 90°. And if only one-fourth of the connections are approximately 90°, then those angled connections should be widely distributed along the length of the chamber instead of being concentrated in one region.

It can also be advantageous to arrange the pipe segments 42 in such a way that the resulting wash chamber lies in more than one plane. Hence, a serpentine, spiral or skewed arrangement of pipe segments 42 can produce beneficial effects in promoting the kind of turbulence that contributes to effective mixing and cleaning of the plastic fragments 28 as they make their excursion through an elongated chamber. Of course, creating bends of more than 90° would significantly increase the back pressure against which the pump 34 must work; so angles between adjacent segments of between 45° and 90° are preferred.

When bends in the elongated chamber 40 are not enough to create the desired turbulence in the moving water, another means must be provided to cause the plastic fragments 28 to twist and turn and rub against one another as they move through the chamber. The preferred means is a plurality of static turbulence generators that are placed within and distributed at spaced locations along the elongated chamber 40. Turning now to FIGS. 4, 5 and 6, a plurality of turbulence generators in the form of cylindrical tubes 46 are shown. When the elongated washing chamber 40 is a heavy-duty (Schedule 80) plastic pipe, typically CPVC, it is possible to drill a plurality of holes through the liquid-impervious walls of the pipe, in planes that are transverse to the longitudinal axis 48 of the chamber. Inserting tubes 46 in these holes and sealing the joint around the tubes creates what amounts to an obstacle course for the plastic fragments 28 as they are pushed through the chamber 40. And to increase the turbulence created by a series of tubes 46, it is advantageous for successive tubes to be oriented 90° apart. Hence, looking longitudinally along the axis 48 of such an embodiment, a viewer could see the first one of a set of tubular pieces $\mathbf{46}_v$ oriented vertically; behind the first tubular piece would be seen the first one of another set of horizontally oriented tubular pieces $\mathbf{46}_h$.

While it is clear from FIG. 4 of the drawing that the tubes 46 are oriented 90° with respect to the walls of the chamber 40, this need not necessarily be so in all cases. If for some reason a different angle should be chosen, it is expected that the tubes 46 would continue to generate a desirable turbulence, as long as the tubes are sized and located appropriately. As for size, it is believed that the tubes 46 should have a diameter of at least 20 percent of the diameter of the cylindrical chamber 40, and the tubes should be located so that their axes are coincident with diametral lines across the chamber. Expressed in other words, the tubes 46 will be centrally located within the wash chamber 40, as the chamber is viewed along a longitudinal axis. The preferred ratio between the diameter of a tube 46 and the diameter of the wash chamber 40 is $\frac{1}{4}$.

Perhaps it should be mentioned that a cylindrical wash chamber has been illustrated, because cylindrical pipes are so readily available as "off-the-shelf" items. But a wash chamber having a generally square cross-section could be used, and the cross pieces 46 that contribute to turbulence in the chamber may be cylindrical or square or elliptical, etc. The exact shape of the turbulence members 46 is not what is important; rather, what's important is whether the members will be effective in contributing to the desired mixing and turning of plastic fragments 28 as they travel through a wash chamber.

The sizing of turbulence members 46 has been discussed, but the quantity and spatial distribution of members along the length of a chamber 40 is also important. Taking a cue from certain aerodynamic principles, it is preferred that adjacent turbulence members should be spaced apart no further than ten times the diameter of the "upstream" member. That is, it is believed that the turbulence achieved by a given member 46 will begin to dissipate to negligible levels at a distance downstream of the member equal to $10 \times d_1$, where $d_1$ is the diameter of the member being considered. So unless there is an elbow in the chamber 40 that is close enough to a given member 46 to contribute to the wanted turbulence, then another member should be placed across the flow of fragments 28 and cleaning liquid—to generate a fresh condition of turbulent flow. This relationship is illustrated in FIG. 6.

It should probably be mentioned that the only difference between the turbulence members 46 in FIG. 4 and those in FIG. 5 is relative length. The length of the turbulence generators 46 in FIG. 4 is exactly the same as those in FIG. 5; but the diameter of the wash chamber is smaller in FIG. 4 than it is in FIG. 5. This means that the members 46 in FIG. 5 will not extend all the way across the diameter of the wash chamber. The mixing of fragments 28 with cleaning liquid in a chamber like that shown in FIG. 5 will be essentially the same as the mixing achieved in a FIG. 4 embodiment, as long as the member length is almost as great as the diameter of the wash chamber. But even a turbulence generator that is only one-fourth that of the wash chamber's diameter will achieve significant turbulence, because there is substantial turbulence realized from the distal end of a member protruding in a cantilevered fashion into a stream of flowing liquid. And increasing the number of generators can compensate for any decrease in turbulence that may be caused by shorter members. But those skilled in structural dynamics will appreciate that the rigidity with which a turbulence generator is anchored will obviously be much greater when both ends of a member 46 can be anchored to the walls of a wash chamber.

Keeping in mind that it has been stated that a washing chamber need not be cylindrical in order to be effective, it will perhaps be useful to define a geometrical term: "major axis"—when referring to certain relative sizes in this disclosure. When the washing chamber 40 is a cylinder, any diameter of that cylinder will be understood to be its major axis. If the washing chamber is a square tube, any side of the square will be its major axis. And if the washing chamber has a rectangular cross-section, its longer side will be its major axis.

Turning next to FIG. 7, an alternate embodiment of a turbulence generator is shown—in the form of a partial sleeve 50 that is adapted to fit interiorly of a smooth wash chamber. Assuming that commercially available plastic pipe (of polyvinyl chloride) is to be used as the major structural part of a wash chamber, a formed sleeve 50 with transverse undulations 52 is sized to nest into the top of the wash chamber as the chamber is installed. The undulations may be sinusoidal, such that a cross-section of the sleeve might be suggestive of a corrugated steel culvert; or the undulations may be angular, to lend even more agitation to the liquid flowing past. By placing the sleeve 50 in only the top of the wash chamber, there will be at least some resulting turbulence in the bottom of the chamber but there will no obstacles to the free movement of liquid. Hence, there will be no tendency for material that has become dislodged from the fragments 28 to accumulate in what would otherwise amount to grooves or trenches in the bottom of the wash chamber. The descriptive term "top" is not being used in an absolute sense, but rather to refer to the opposite of "bottom." Hence, the arc encompassed by the "top" of the sleeve 50 is illustrated as encompassing an angle of 180°, but it may be as much as 270°, as long as there is no opportunity to accumulate waste in the bottom of the wash chamber.

Of course, if a given wash chamber 40 is made up of a mixture of horizontal and vertical pipe segments, the sleeves 50 should probably be installed in only the horizontal sections. By omitting sleeves in the vertical segments, there will be no part of the undulations that could function as a ledge to trap unwanted matter.

To ensure that a sleeve 50 remains in the top of a section of horizontal wash chamber (and does not rotate so that it comes to rest in the bottom), the sleeve has an integral flange 54 that is designed to fit flush with a conventional flange on the end of a pipe section. The flange 54 has a hole pattern that is the same as that on the pipe section; so passing bolts through the prepared holes will fix the sleeve 50 in place and preclude its rotation with respect to the pipe. If the flange 54 does not encompass 360°, an appropriate gasket-like member can be used to complete the circle and ensure a leak-proof joint.

Turning once again to FIG. 3, sufficient pipes are joined together to create a washing chamber 40 that is many feet long. For an embodiment designed to accommodate 600 pounds of polystyrene per hour, a washing chamber made of 4 inch CPVC pipe would typically have a length of about 60 feet. A pump 34 rated at 150 gallons per minute will propel the cleaning liquid and the entrained fragments 28 through the wash chamber in about 45 seconds. With such a rapid processing time, the apparatus 20 need not be a bottleneck in any material recycling facility; and waste containers and packaging that were once sent off to somebody's landfill can instead be converted into salvagable material.

To complete a description of the apparatus 20, the cleaning liquid and fragments 28 that leave the wash chamber 40 are directed to a separator 60. The separator 60 is so-named because of the function it performs in separating solid fragments from liquid. The preferred form for a separator 60 is a large steel tank 62, fabricated to be tall relative to its base and galvanized to resist corrosion, and having two inlets for the mixture of liquid and fragments. If the plastic fragments 28 are polystyrene or some other plastic having a positive bouyancy, the mixture of liquid and fragments that are expelled from the washing chamber will normally enter the separator at a low entrance 64, which will be below the normal liquid level in the tank. The fragments 28 will float to the top of the tank 62 until a sufficient quantity of fragments have reached the level of a lip 66 that serves as the exit (for plastic fragments) from the tank. The continued buildup of fragments will cause the fragments to begin to fall over the lip 66, which is lower than the upper walls of the tank 62. The fragments 28 will be prompted to fall over the lip by virtue of pressure exerted from new fragments entering the tank 62, and by the deflector 68 at the back of the tank.

If the plastic fragments being recovered are heavier than water, the separator 60 will be switched to its alternate mode of operation by placing a wire screen across the tank 62 near the level of the lip 66. Also, the liquid input to the separator will be through an upper inlet rather than the lower inlet. Negative buoyancy fragments will be caught on the wire screen, while the cleaning water will pass through the screen and into the bottom of the tank 62. Whether the fragments 28 have a positive or a negative buoyancy, the cleaning water will normally be recirculated back to the reservoir 30 through appropriate pipes. Filters in the reservoir, located to the side of the collector ring 32, will serve to trap matter that has been washed off the fragments. Such filters are removable out of the open top of the reservoir for cleaning as often as is necessary.

Before the fragments 28 leave the separator 60, they are sprayed with a shower of clean rinse water, which is directed downwardly onto the fragments by nozzles 70 that are located above and in front of the lip 66. After passing through the shower of rinse water, the now-clean and rinsed fragments are pushed over the lip where they fall, by gravity, onto a conveyor 72 below the lip. The conveyor 72 carries the wet fragments into one end of an elongated drier 80, which has a combination of high volume fans 82 and heaters 84. After passing through the drier 80 the fragments 28 fall off the conveyor into containers or other collecting means for feeding the fragments to a pelletizer (not shown), which will put the fragments into a customary form for subsequent use in making some new product. In normal practice, the pelletizer will be on the premises of the material recycling center, but it could be at some remote location, such as a factory where recycled plastic can be used.

Another characteristic of the cleaning apparatus 20 is that it is particularly amenable to modular construction. Because of this, an apparatus in accordance with this invention is capable of being altered in size to fit particular requirements. For example, if the cleaning liquid is to be a mixture of heated water and detergent, and it is determined that a longer washing chamber 40 is needed to achieve the desired level of cleanliness, the apparatus could be shut down, modified, and returned to service in a very short period of time-because of the ease of adding more segments to the washing chamber. And the heat that is discharged from the drier 80 through outlet 86 may either be used to help heat the cleaning liquid or diverted to some other desired use.

While only the preferred forms of the invention have been disclosed herein, it will no doubt be apparent to those skilled in the art that variations and modifications could be made-without departing from the spirit of the invention. Hence, the breadth of the invention should be understood to be limited only by the claims appended hereto.

What is claimed is:

1. A cleaning apparatus for fragments of plastic that have been recovered from plastic containers, said containers having been soiled through use by contact with liquid-soluble matter, and the plastic fragments being eligible for recycling once they have been cleaned, comprising:

a. means for supplying to the entrance of an elongated chamber a continuous stream of liquid under pressure, said stream having entrained therein plastic fragments that are to be cleaned, and the liquid being one that is appropriate for cleaning the plastic fragments;

b. an elongated chamber defined by liquid-impervious walls, the chamber having an entrance and an exit and a longitudinal axis therebetween, and the chamber having a cross-sectional shape which is defined by establishing a plane that passes transversely through the chamber and perpendicularly to the longitudinal axis, and the walls of the chamber serving as the boundaries for a major axis that lies in said transverse plane;

c. a plurality of turbulence generators distributed longitudinally along the interior of the elongated chamber, said turbulence generators constituting static structural pieces, each having a width that contributes to turbulence in a liquid flowing through the elongated chamber and past the turbulence generators, and said turbulence generators extending respectively in directions that make significant angles with respect to the longitudinal axis of the chamber, and the orientation of a given turbulence generator forming an angle of at least 45 degrees with respect to the orientation of an immediately adjacent turbulence generator when a serial array of such generators are viewed in a direction that is parallel to the longitudinal axis of the chamber, and each turbulence generator having a length that is at least 25 percent of the length of the chamber's major axis, and the width of each turbulence generator being less than one-third of the chamber's major axis, such that there remains ample space for a liquid and any entrained plastic fragments to pass the turbulence generators as the liquid and plastic fragments pass longitudinally from the chamber's entrance to its exit, whereby turbulence in the liquid that serves as the carrier for the plastic fragments will also serve to clean the plastic fragments; and d. separator means located at the exit of the elongated chamber for separating the plastic fragments from the liquid that has been used to clean the fragments during their excursion through the elongated chamber.

2. The cleaning apparatus as claimed in claim 1 wherein the elongated chamber is generally cylindrical, such that the transverse cross-sectional shape of the elongated chamber is generally circular.

3. The cleaning apparatus as claimed in claim 1 wherein the turbulence generators constitute tubular pieces that are oriented so as to be approximately perpendicular to the longitudinal axis of the chamber and hence approximately perpendicular to the flow of liquid through the chamber.

4. The cleaning apparatus as claimed in claim 3 wherein the turbulence generators constitute right cylinders that are mounted within the elongated chamber so as to define approximately ninety-degree angles with respect to the chamber walls.

5. The cleaning apparatus as claimed in claim 4 wherein the diameter of the turbulence generators is approximately one-fifth the diameter of the elongated chamber.

6. The cleaning apparatus as claimed in claim 1 wherein the spacing between any given turbulence generator and the turbulence generator that is immediately downstream of said given turbulence generators is about ten times the width of the upstream turbulence generator.

7. The cleaning apparatus as claimed in claim 1 wherein the angle formed by two immediately adjacent turbulence generators is approximately ninety degrees.

8. The cleaning apparatus as claimed in claim 1 wherein the elongated chamber is generally cylindrical and has a diameter of about four inches, and wherein each of the turbulence generators are generally cylindrical and have a diameter of about one inch.

9. The cleaning apparatus as claimed in claim 1 wherein the elongated chamber is broken into a serial array of elongated segments, and at least most of the segments are connected to adjacent segments in such a way as to define an angle of at least 45 degrees between adjacent segments, whereby a cleaning liquid that flows through the elongated chamber will experience significant changes of direction as the liquid passes from one segment to another.

10. The cleaning apparatus as claimed in claim 9 wherein at least one-fourth of the elongated segments are connected to adjacent segments by an angle of approximately 90 degrees, and wherein the approximately 90 degree connections are widely distributed along the length of the chamber, whereby major changes occur in the direction in which cleaning liquid moves through the chamber, and those changes are widely distributed along the length of the chamber.

11. The cleaning apparatus as claimed in claim 1 wherein the entrance and the exit of the elongated chamber are bounded by pipe flanges, whereby the chamber may be installed in the manner of traditional piping in a closed loop for the continuous passage therethrough of cleaning liquid.

* * * * *